US012455130B1

(12) United States Patent
Loveday, IV et al.

(10) Patent No.: US 12,455,130 B1
(45) Date of Patent: Oct. 28, 2025

(54) FIREARM MAGAZINE WITH MOLDED SEAM

(71) Applicant: Elite Tactical Systems Group, LLC, Cheyenne, WY (US)

(72) Inventors: George E. Loveday, IV, Lenior City, TN (US); Nathan Dudney, Nashville, TN (US); Mark Hillis, Manchester, TN (US); Evan Dungan, Christiana, TN (US); Joel Stanley, Smyrna, TN (US)

(73) Assignee: Elite Tactical Systems Group, LLC, Cheyenne, WY (US)

( * ) Notice: Subject to any disclaimer, the term of this patent is extended or adjusted under 35 U.S.C. 154(b) by 0 days.

(21) Appl. No.: 18/581,324

(22) Filed: Feb. 19, 2024

Related U.S. Application Data

(60) Provisional application No. 63/446,891, filed on Feb. 19, 2023.

(51) Int. Cl.
*F41A 9/65* (2006.01)

(52) U.S. Cl.
CPC ..... *F41A 9/65* (2013.01)

(58) Field of Classification Search
None
See application file for complete search history.

(56) References Cited

U.S. PATENT DOCUMENTS 1,382,680 A * 6/1921 Searle ..... F41A 21/488 89/196
1,494,524 A * 5/1924 Adamson ..... F41A 21/00 285/391
2,387,691 A * 10/1945 Sunderland ..... F41A 17/38 89/149
3,443,334 A * 5/1969 Ardolino ..... F41A 9/70 42/50
3,577,860 A * 5/1971 Jestrabek ..... F41A 9/70 42/50
3,603,020 A * 9/1971 Wiese ..... F41A 9/69 42/88
3,732,643 A * 5/1973 Wells ..... F41A 17/38 42/50
4,472,900 A * 9/1984 Howard ..... F41A 9/65 42/50
4,831,761 A * 5/1989 Kulakow ..... F41A 9/67 42/50
4,901,463 A * 2/1990 Chesnut ..... F41A 9/65 42/50
5,113,605 A * 5/1992 Kim ..... F41A 9/71 42/50
5,279,059 A * 1/1994 Howard ..... F41A 9/63 42/50

(Continued)

*Primary Examiner* — Derrick R Morgan
(74) *Attorney, Agent, or Firm* — J. Kenneth Hoffmeister

(57) ABSTRACT

A firearm magazine having a body constructed by a two-stage process. First, a fabrication stage shapes a sheet material into a substantially tubular magazine body with a joint having one or more retainers formed along the mating ends. Second, a molding stage joins the mating edges using a plastic that fills the joint between the mating edges. One or more retainers along the mating ends are designed to distribute forces applied to the magazine body along the seam and provide support from the sheet material to secure the connection rather than rely on the tensile strength of the filler material to maintain the joinder of the mating edges.

20 Claims, 5 Drawing Sheets

(56) References Cited

U.S. PATENT DOCUMENTS 5,584,136 A * 12/1996 Boland ..... F41A 9/71 42/50
6,739,082 B2 * 5/2004 Christensen ..... F41A 9/70 42/49.02
7,513,537 B2 * 4/2009 Mosing ..... F16L 37/2445 285/401
8,006,423 B1 * 8/2011 Alzamora ..... F41A 9/65 42/50
8,028,455 B1 * 10/2011 Battaglia ..... F41A 9/71 42/49.02
8,225,541 B2 * 7/2012 Bigley ..... F41A 9/70 42/49.01
8,607,489 B1 * 12/2013 Calvert ..... F41A 9/71 42/49.02
8,850,732 B2 * 10/2014 Zheng ..... F41A 9/70 42/49.02
8,887,428 B1 * 11/2014 Lemoine ..... F41A 9/63 42/49.02
8,966,801 B1 * 3/2015 Bentley ..... F41B 11/55 42/50
D738,454 S * 9/2015 Smith ..... D22/108
9,239,197 B1 * 1/2016 Christensen ..... F41A 9/65
9,328,982 B2 * 5/2016 Ladner ..... F41A 9/71
10,066,886 B2 * 9/2018 Vilardi ..... F41A 9/69
10,527,374 B1 * 1/2020 August ..... F41A 9/66
10,809,027 B2 * 10/2020 Michut ..... F41A 9/70
11,073,353 B2 * 7/2021 Hendricks ..... F41A 21/487
11,662,165 B1 * 5/2023 Viani ..... F41A 9/65 42/50
12,203,719 B1 * 1/2025 Hart ..... F41A 9/70
12,203,720 B2 * 1/2025 Zusman ..... B29C 45/14311
2010/0101132 A1 * 4/2010 Jacobson ..... F41A 9/65 42/50
2010/0154271 A1 * 6/2010 Victor ..... F41A 17/063 42/70.07
2010/0154275 A1 * 6/2010 Faifer ..... F41C 23/16 29/592
2010/0281737 A1 * 11/2010 Cahill ..... F41A 9/70 42/50
2012/0233899 A1 * 9/2012 Daniel ..... F41A 9/65 42/49.01
2013/0086834 A1 * 4/2013 Battaglia ..... F41A 9/65 42/49.02
2014/0075810 A1 * 3/2014 Mikroulis ..... F41A 17/36 42/50
2015/0316340 A1 * 11/2015 Ladner ..... F41A 9/71 42/49.02
2016/0209140 A1 * 7/2016 Toth ..... F41A 9/65
2016/0320155 A1 * 11/2016 Singh ..... F41A 17/72
2017/0146308 A1 * 5/2017 Plumb ..... F41A 9/65
2018/0031342 A1 * 2/2018 Faifer ..... F41A 9/71
2018/0347929 A1 * 12/2018 Hsu ..... F41A 9/71
2021/0080204 A1 * 3/2021 Yeates ..... B29C 45/14336
2021/0215446 A1 * 7/2021 Czarnecki ..... G05B 15/02
2022/0136789 A1 * 5/2022 Lee ..... F41A 9/62 42/49.01
2023/0235981 A1 * 7/2023 Williams ..... F41A 9/71 42/49.01
2024/0219134 A1 * 7/2024 Zusman ..... F41A 9/70
2024/0344793 A1 * 10/2024 Royce ..... F41A 9/70
2024/0369316 A1 * 11/2024 Vitulli ..... F41A 9/70

* cited by examiner

FIREARM MAGAZINE WITH MOLDED SEAM

BACKGROUND

The basic design of a firearm magazine is constrained by the size of the magazine well of the associated firearm and the size of the rounds to be held by the magazine. The external and internal dimensions dictate the wall thickness. Often, the wall thickness is exceedingly thin offering little leeway in the choice of the materials used to fabricate a magazine or may require compromises when less optimal materials are used. Thus, the material or materials used in the magazine is a significant design choice.

Double stack magazines are a particularly good testbed for materials and construction techniques. In a double stack magazine, the internal forces applied to walls of the magazine are significant. The linear pressure from the spring-loaded follower pushing cartridges toward the feed lips faces resistance where the magazine narrows to merge the double stack of cartridges into a single stack. This causes some amount of swelling in virtually all magazines. However, if the design of the magazine and the materials used in its construction are not adequate, the magazine may experience excessive swelling causing problems such as making it difficult to insert or release the magazine from the magazine well. Additionally, the outward pressure can cause the feed lips to spread or crack, which can cause feed failures and, in extreme cases, the failure to retain cartridges in the magazine.

Conventional magazines are made from metals (e.g., steel), plastics (e.g., nylon), or a combination of the two. Metals generally provides strength that cannot be matched by plastics at the same thickness. Metal magazines are typically constructed from a sheet material using typical metal fabrication techniques (e.g., cutting, punching, and folding) to shape the magazine. The free ends are welded together to complete the enclosure. Welding provides a strong connection that is resistant to separation due to the internal forces in a loaded magazine. However, welding does not create a clean connection and additional steps (e.g., grinding, polishing, coating) are required to remove the excess weld material, make the weld flush with the inner and outer faces of the magazine wall, and properly finish the seam. These extra steps add time and expense to the manufacturing process. Moreover, a certain number of defects from misalignment of the mating edges is accepted in an automated welding process. While many of these imperfect magazines can be rehabilitated through an offline inspection and correction process (e.g., re-welding), it is laborious and inefficient.

It is with respect to these and other considerations that the present invention has been made.

SUMMARY OF THE INVENTION

The following summary discusses various aspects of the invention described more fully in the detailed description and claimed herein. Itis not intended to be limiting and should not be used to limit the claimed invention to only such aspects or to require the invention to include all such aspects.

The magazine body is constructed by a two-stage process. First, a fabrication stage shapes a sheet material into a substantially tubular magazine body with a joint having one or more retainers formed along the mating ends. Second, a molding stage joins the mating edges using a plastic that fills the joint between the mating edges. One or more retainers along the mating ends are designed to distribute forces applied to the magazine body along the seam and provide support from the sheet material to secure the connection rather than rely on the tensile strength of the filler material to maintain the joinder of the mating edges.

The hybrid firearm magazine includes a body. The body defines a front wall, a back wall, and side walls. The top of the body defines an opening bounded by the feed lips. The bottom of the body also defines an opening. The body is constructed by a two-stage process. The first stage is a fabrication process transforming the sheet material into the desired shape. The second stage is a molding process that forms the seam strengthening and completing the body.

At least one wall has two sections formed by bringing the opposing ends of the sheet material into proximity leaving a gap therebetween and nominally aligning the corresponding wall sections in the same plane. Cut into the opposing ends is at least one retainer. During the molding stage, the body is placed over a mold insert and fitted into a mold. A plastic filler is injected into the mold to form the seam. The filler occupies the gap including the areas around the retainers. The seam connects the opposing ends of the wall sections and maintains the alignment of the wall sections.

The two sections of the wall are substantially planar. The ends of the wall sections are fabricated with an edge treatment such that the ends are not flat where the plastic engages the opposing ends of the sheet material. The plastic fills the gap to form the seam and flows around the edge treatments to encapsulate the ends of the wall sections. The projections or lips of the seam capture the ends of the wall sections therebetween. This structure minimizes or eliminates the likelihood that the seam will become dislodged from within the gap.

The thickness of the seam may vary depending upon the dimensional parameters of the magazine. The wall of the magazine containing the seam generally presents a substantially smooth linear face. The seam may be substantially the same thickness as the wall sections in the area proximate to the seam or part of a larger overmold or undermold that extends beyond the ends of the wall sections and effectively forms a face of the wall being joined.

The retainer is designed to facilitate using a plastic as a seam to join the opposing ends of the wall sections. First, the geometries of the retainer parts provide a greater surface area for the bond between the wall sections and the seam. Second, depending upon the retainer design, the retainer utilizes the inherent tensile strength of the tab and the geometries of the tab and the slot to translate the tensile stress into compression loads carried by the plastic seam.

During the fabrication process of a tab and slot retainer, the tab is mated with the slot. The tab and the slot have generally complementary geometries and are dimensioned to maintain the gap between the opposing wall section ends. In various embodiments, the tab includes a head having projections and the slot includes a mouth formed by projections. The head projections and the mouth projections are operatively arranged such that at least of a portion of the compressive forces on the seam are resisted by the opposite projection. Retainers trap the filler material within an area bounded by the sheet material. The mouth projections formed by the sheet material provide resistance and hold the filler material against the forces attempting to separate the wall ends at the seam. Utilizing multiple retainers distributes the load and further strengthens the effectiveness of the seam.

BRIEF DESCRIPTION OF THE DRAWINGS

Further features, aspects, and advantages of the present disclosure will become better understood by reference to the following figures wherein like reference numbers indicate like elements throughout the several views.

DETAILED DESCRIPTION

Aspects of a firearm magazine with molded seam are described herein and illustrated in the accompanying figures. The magazine body is constructed by a two-stage process. First, a fabrication stage shapes a sheet material into a substantially tubular magazine body with a joint having one or more retainers formed along the mating ends. Second, a molding stage joins the mating edges using a filler material that fills the joint between the mating edges. One or more retainers along the mating ends are designed to distribute forces applied to the magazine body along the seam and provide support from the sheet material to secure the connection rather than rely on the tensile strength of the filler material to maintain the joinder of the mating edges.

For convenience, generic references to the materials used in the construction of the hybrid magazine may be used. Such references are not intended to be limiting. References to "metal" are intended to encompass any substantially rigid sheet material suitable for use in a magazine having greater strength/less ductility than plastics and other similar materials. References to a "filler material" are intended to encompass materials that have a lower melting point than metals, such as plastics, epoxy resins, and similar materials. Such filler materials may be used with molding, screen printing, or similar techniques. Specifically, the term "plastic" is intended to encompass to any moldable material having a polymeric base including thermoset plastics, thermoplastics, and plastic composites (e.g., a glass filled nylon) and may include various additives. By way of example, Table 1 lists some of the relevant physical properties of a representative metal and a representative plastic used in conventional magazines.

TABLE 1

Relevant Physical Properties of Representative Materials

| Material | 1010 Cold Rolled Steel | 1020 Cold Rolled Steel | Radel ® R PPSU |
|---|---|---|---|
| Compressive Strength | | 172 MPa (25,000 psi) | 98.9 MPa (14,344 psi) |
| Tensile Strength, Yield | 305 MPa (44,200 psi) | 350 MPa (50,763 psi) | 69.6 MPa (10,095 psi) |

TABLE 1-continued

Relevant Physical Properties of Representative Materials

| Material | 1010 Cold Rolled Steel | 1020 Cold Rolled Steel | Radel ® R PPSU |
|---|---|---|---|
| Shear Strength | | 287 MPa (41,626 psi) | 62.7 MPa (9,094 psi) |

Figure 1:
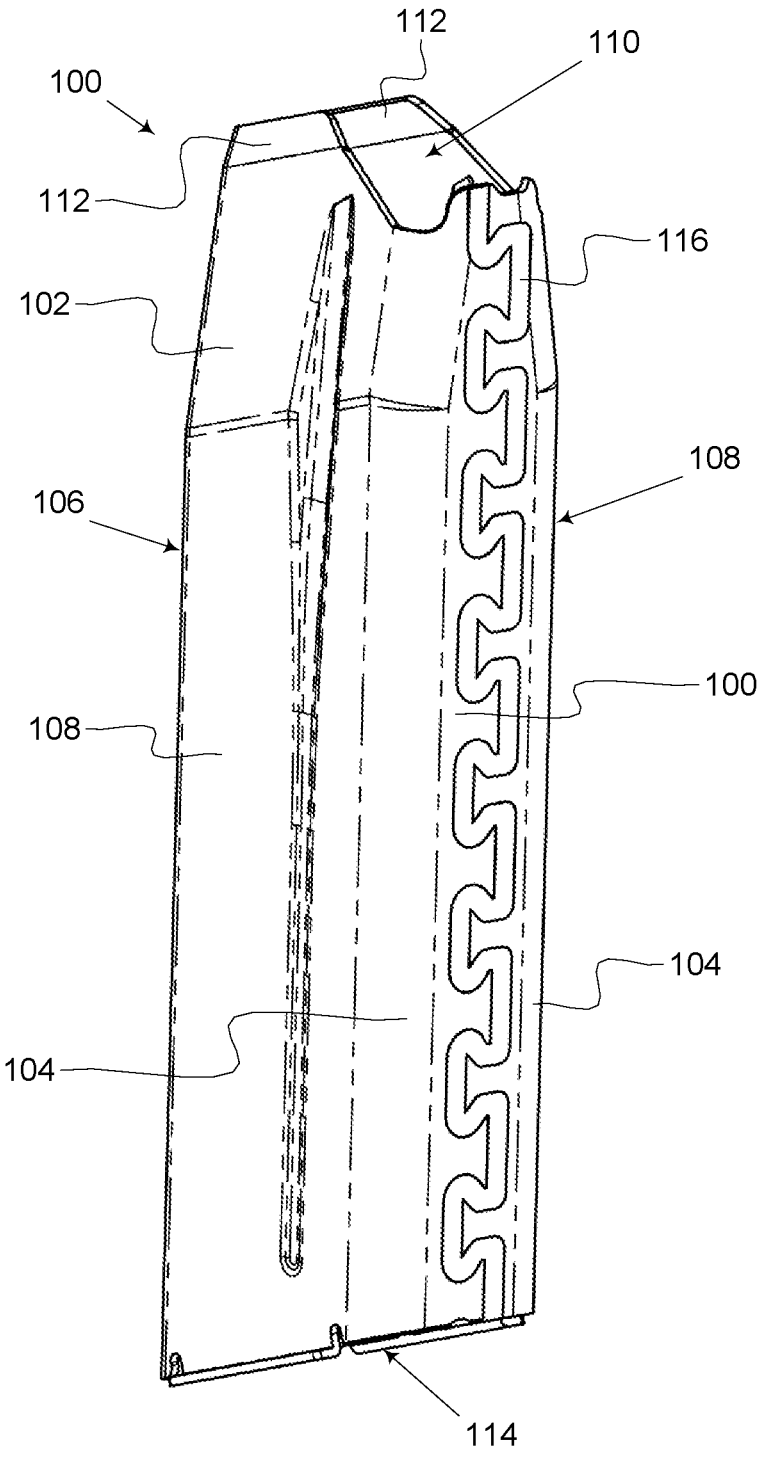
FIG. 1 is front perspective view of an embodiment of a firearm magazine.

FIG. 1 is a front perspective view of an embodiment of a hybrid firearm magazine 100 illustrating aspects of the present invention. The magazine 100 includes a body 102. Those skilled in the art will recognize that a complete magazine includes other components not illustrated in FIG. 1, such as a spring, a follower, and a floor plate. The body 102 is a substantially tubular housing that is shaped from a sheet material. The body 102 defines a front wall 104, a back wall 106, and side walls 108. The top of the body 102 defines an opening 110 bounded by the feed lips 112. The bottom of the body also defines an opening 114. One skilled in the art understands that the floor plate attaches to the body and covers the bottom opening. The follower is positioned inside the body and the spring is positioned between the floor plate and the follower. The mating edges of the body 102 are joined at a seam 116 using a filler material. While the illustrated embodiment of the magazine 100 is illustrated as a double-stack box magazine having a substantially tubular housing where the cartridges are merged into a single column, the present invention is applicable to other types, shapes, and designs of firearm magazines.

The body 102 is constructed by a two-stage process. The first stage is a fabrication process transforming the sheet material into the desired shape. In an exemplary embodiment, the sheet material is a metal, such as aluminum or steel. However, other rigid materials may be used without departing from the scope and spirit of the invention. The primary fabrication process techniques used in forming the sheet material into the body include one or more of cutting, forming, machining, punching, and stamping; however, other fabrication process techniques may be employed. The specific details of the fabrication process vary depending upon the design features of the magazine. For purposes of the present invention, the most significant aspects of the fabrication process are folding the sheet material into the substantially tubular shape of the body 102 and forming any coupling structures along the mating edges of the sheet material. The second stage is a molding process that forms the seam 116 strengthening and completing the body 102. Typically, fabrication is done using injection molding; however, casting, compression molding, and other molding techniques may be used to form the seam 116. In an alternate embodiment, the second stage is a screen printing or similar process applying an epoxy or other similar filler material that does not require molding and may include any hardening process required by the filler material. While the embodiment described herein includes a body having a single seam 116, other embodiments with multiple separate body portions joined in the manner described herein with multiple seams 116 are considered to fall within the scope and spirit of the present invention. Further, in various embodiments, the body described herein may be only a portion of the entire body of the magazine with other portions of the body fabricated using different techniques.

Figure 2:
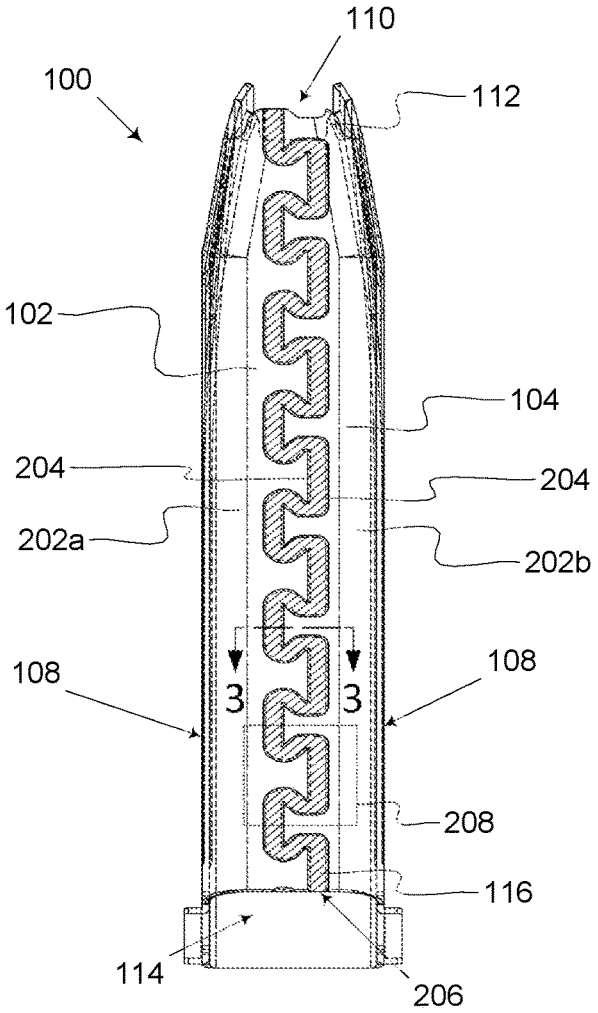
FIG. 2 is a front elevation view of an embodiment of the magazine.

FIG. 2 is a front elevation view of an embodiment of the magazine 100 illustrating various aspects of the present embodiment. One aspect of the present invention is that the body 102 is not continuous because the body 102 is formed from a sheet material. At least one wall has two sections 202*a*, 202*b* formed by bringing the opposing ends 204 of the sheet material into proximity leaving a gap 206 therebetween and nominally aligning the corresponding wall sections 202*a*, 202*b* in the same plane. The multi-sectional wall can be any of the walls of the body 102, but, typically, it is either the front wall 104 or the back wall 106. In the illustrated embodiment, the multi-sectional wall is the front wall 104.

Cut into the opposing ends 204*a*, 204*b* is at least one retainer, or trapping feature, 208, which is encompassed by the broken line box in FIG. 2. In the illustrated embodiment, the retainers 208 run the entire length of the front wall 104. Aspects of the present invention allow for varying the number of retainers 208 and the spacing between the retainers 208.

During the molding stage, the body 102 is placed over a mold insert and fitted into a mold. A plastic filler is injected into the mold to form the seam 116. The filler occupies the gap 206 including the areas around the retainers 208. The seam 116 connects the opposing ends 204 of the wall sections 204*a*, 204*b* and maintains the alignment of the wall sections 202*a*, 202*b*.

Figure 3:
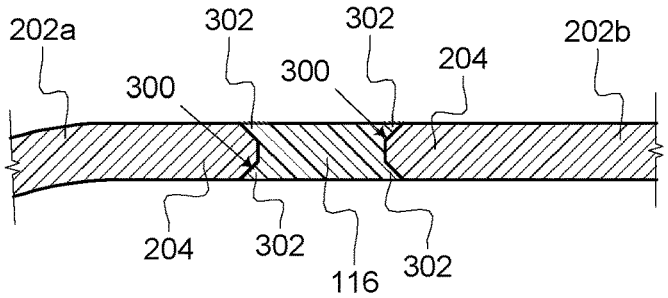
FIG. 3 is a top elevation sectional view taken along section 3-3 of FIG. 2.

FIG. 3 is a top elevation sectional view taken along section 3-3 of FIG. 2 showing the seam joining the opposing ends of the wall sections. The two sections of the front wall 104 are substantially planar. The ends 204 of the wall sections 202*a*, 202*b* are not flat where the plastic engages the opposing ends 204 of the sheet material. More specifically, the wall section ends have a convex edge treatment 300 such as a radius cut, a bevel, a chamfer, and other similar softening of the edges. Aspects of the present invention allow for different edge treatments to be used at different points for aesthetic or practical reasons. For example, a chamfer may be applied along substantially straight edge portions while a radius cut may be used along curved edge portions for ease of manufacturing. While a convex edge treatment is generally easier to fabricate, a concave edge treatment accomplishes the same result.

During the molding stage, the body 102 is placed over a mold insert and fitted into a mold. The plastic fills the gap 206 to form the seam 116 and flows around the convex edge treatments 300 to encapsulate the ends 204 of the wall sections 202*a*, 202*b*. The resulting seam 116 is substantially "H"-shaped or "I"-shaped. The projections or lips 302 of the seam 116 capture the ends 204 of the wall sections 202*a*, 202*b* therebetween. This structure minimizes or eliminates the likelihood that the seam 116 will become dislodged from within the gap 206. It is desirable that the wall sections 202*a*, 202*b* are substantially aligned prior to molding the seam 116 to prevent unnecessary stress from being placed on the seam 116.

The thickness of the seam 116 may vary depending upon the dimensional parameters of the magazine. The wall of the magazine 100 containing the seam 116 generally presents a substantially smooth linear face. Inconsistencies such the seam 116 being substantially thicker than the wall sections 202*a*, 202*b* in the area proximate to the seam 116 can cause rounds to catch in the magazine or prevent clean insertion and removal of the magazine from the magazine well. In various embodiments, the seam 116 is limited to being substantially the same thickness as the wall sections 202*a*, 202*b* in the area proximate to the seam 116. In other embodiments, the seam 116 may be part of a larger overmold or undermold that extends beyond the ends 204 of the wall sections 202*a*, 202*b* and effectively forms a face of the wall being joined 104.

Figure 4:
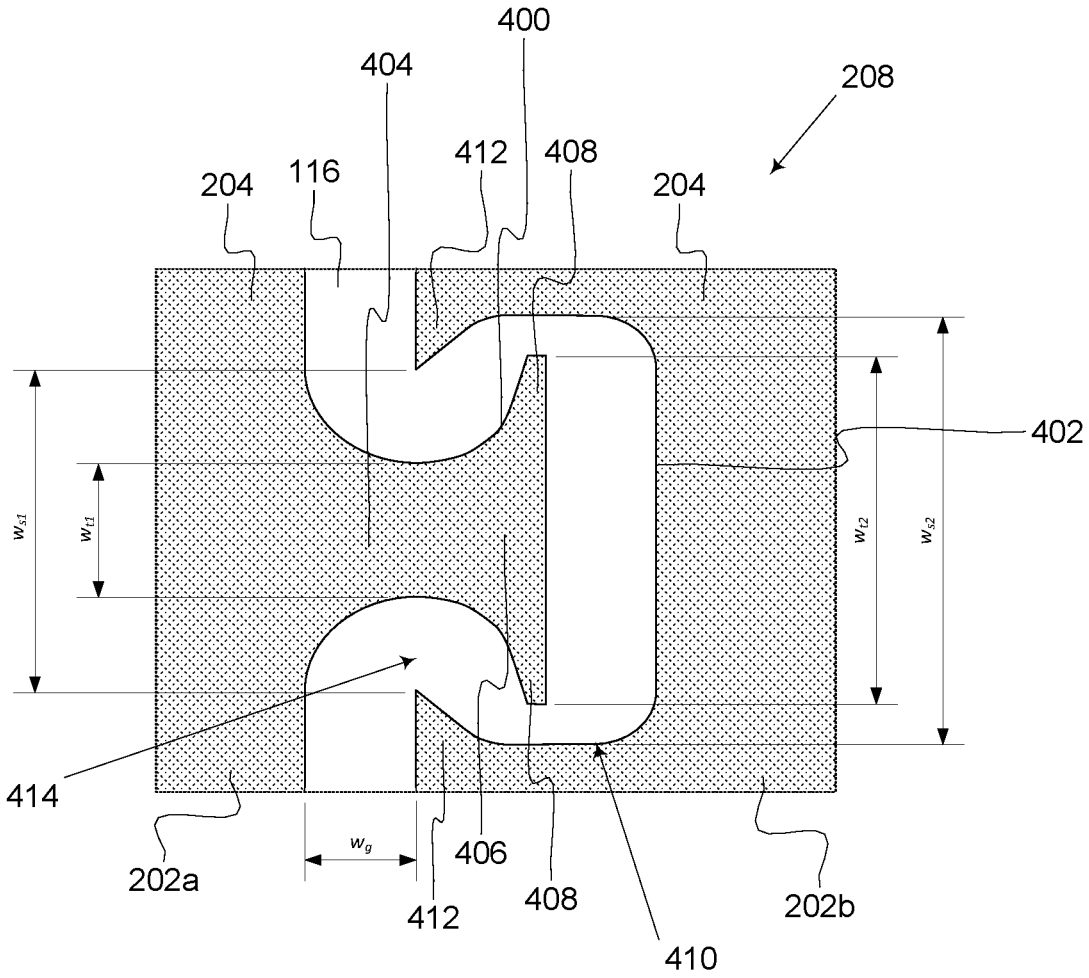
FIG. 4 is an illustration of an embodiment of a single retainer used to join the edges of the magazine.

FIG. 4 is an illustration of an embodiment of a single retainer encompassed by the broken line box 208 of FIG. 2. The retainer 208 includes a tab 400 defined by one wall section 202*a* and a slot 402 defined by the opposing wall section 202*b*. The retainer 208 is designed to facilitate using a plastic as a seam to join the opposing ends 204 of the wall sections 202*a*, 202*b*. First, the geometries of the tab 400 and the slot 402 provide a greater surface area for the bond between the wall sections 202*a*, 202*b* and the seam 116. Second, the retainer 208 utilizes the inherent tensile strength of the tab 400 and the geometries of the tab 400 and the slot 402 to translate the tensile stress into compression loads carried by the plastic seam 116.

The tab 400 has a shaft 404 and a head 406. The shaft 404 has a width $w_{t1}$. The head defines two projections 408 extending substantially perpendicular to the longitudinal axis of the shaft 204 and has a width $w_{t2}$. The head width $w_{t2}$ is greater than the shaft width $w_{t1}$. The slot 402 has a bay 410 with two inward projections 412 forming a mouth or inlet 414. The mouth 414 has a width $w_{s1}$. The bay 410 has a width $w_{s2}$. The bay width $w_{s2}$ is greater than the mouth width $w_{s1}$. The tabs 400 and the slots 402 illustrated herein are representative of the general configuration of the retainer 208. Generally, the head 406 is wider than the shaft 404 and ranges from approximately the width of the mouth 414 to larger than the width of the mouth 414. The shape of the tabs 400 and the slots 402 can vary widely without departing from the scope and spirit of the present invention.

During the fabrication process, the tab 400 is mated with the slot 402. The fabrication technique for mating the tab 400 and the slot 402 depend on the dimensions and geometries of the tab 400 and the slot 402. When the head width $w_{t2}$ is greater than the mouth width $w_{s1}$, additional steps are required in the fabrication process stage to insert the tab 400 into the slot 402. For example, an extra folding step may be required to put the tab 400 and the slot 402 into the same plane after sliding the tab 400 and the slot 402 into an overlapping position. By keeping the head width $w_{t2}$ close to but slightly less than the mouth width $w_{s1}$ fewer steps are required in the fabrication process stage to insert the tab 400 into the slot 402, but the benefits of the retainer 208 are substantially maintained.

The tab 400 and the slot 402 have generally complementary geometries. However, the complementary nature of the geometries is fairly relaxed as the parts do not have to actually mate. Generally, the tab 400 and the slot 402 cooperate to define a portion the gap 206 receiving the filler material and forming the seam 116. The tab 400 and the slot 402 are shaped and dimensioned to maintain the gap 206 between the opposing wall section ends 204. The gap 206 has a nominal width $w_g$ sufficient to receive a plastic that forms the seam 116 during the molding process stage. The gap width $w_g$ may vary along the gap without departing from the scope and spirt of the present invention. For example, in the illustrated embodiment, the gap width $w_g$ is slightly narrower around the area of the tab projections 408. The head 406 is sized to fit within the bay 410 separated by approximately the nominal gap width $w_g$ when assembled. Generally, head width $w_{t2}$ can vary from slightly less than the mouth width $w_{s1}$ to approximately the bay width $w_{s2}$ minus the gap width $w_g$.

In the illustrated embodiment, the head projections 408 and the mouth projections 412 have an edge that runs at angle relative to the longitudinal axis of the body 102. The angular edges of the head projections 408 face the angular edges of the mouth projections 412. The head projections 408 and the mouth projections 412 have substantially similar slopes such that many of the perpendiculars to the tangent of the angular edge of the head projections 408 point in the direction of the mouth projections 412 and vice versa. These angles contribute having at least of a portion of the compressive forces on the seam 116 to be resisted by the opposite projection 408, 412.

Figure 5:
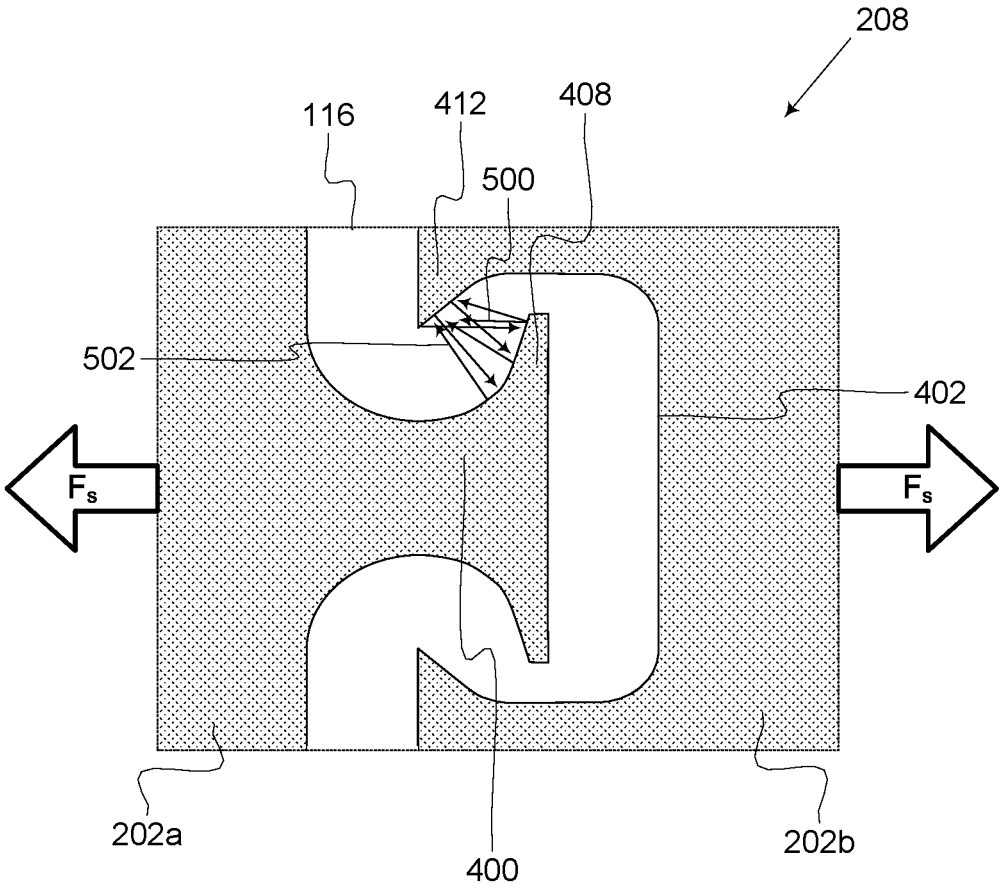
FIG. 5 is an illustration of the response of the retainer and the seam to forces attempting to separate the opposing ends of the wall sections of the magazine.

FIG. 5 illustrates the response of the retainer and the seam to forces attempting to separate the opposing ends 204 of the wall sections 202*a*, 202*b*. At the outset is worth noting that both metal and plastics have adequate compression resistance to withstand crushing of the seam 116. In other words, both a weld and a molded plastic seam suitably handle situations where the opposing ends 204 of the wall sections 202*a*, 202*b* are pushed towards each other. However, plastics tend to have significantly poorer performance against tensile stresses than metals. As a result, even a well-bonded linear seam of a plastic may be insufficient to prevent an increase in the separation between the opposing ends 204 of the wall sections 202*a*, 202*b*. Keep in mind that even a small amount of separation of the opposing ends 204 of the wall sections 202*a*, 202*b* creates problems for the magazine 100. In the field of firearm magazines, movements as small as a few thousandths of an inch are enough to cause swelling and feed lip issues. Swelling of the magazine 100, for example, causes problems inserting and removing the magazine 100 from a magazine well. Separation may also increase the spacing between the feed lip 112 resulting in feed and cartridge retention issues.

In the embodiment of FIG. 5, the head 406 is wider than the mouth 414 (i.e., the head width $w_{t2}$ is greater than the mouth width $w_{s1}$. The head projections 408 overlap the mouth projections 412. When a separating force perpendicular to the seam 116 is applied, for example, by cartridges pressing outwardly against the side walls 108, the wall sections 202*a*, 202*b* are pulled in opposite directions represented by the large arrows $F_s$. As the tab side wall section 202*a* is pulled away from the bay side wall section 202*b*, the head projections 408 push the seam 116 towards the mouth projections 412. At the same time, the mouth projections 412 push the seam 116 towards the head projections 408 in response to the bay side wall section 202*b* being pulled away from the tab side wall section 202*a*. This converts what would normally be a tensile load stretching a basic linear seam into compressive forces on the seam 116. As previously mentioned, the physical properties of a plastic are well suited to handle such compressive forces and maintain the connection between and spacing of the opposing ends 204 of the wall sections 202*a*, 202*b*.

Where the head projections 408 overlap the mouth projections 412, the horizontal components 500 of the compressive forces are generally sufficient to maintain the connection between and spacing of the opposing ends 204 of the wall sections 202*a*, 202*b* regardless of the shape of the tab 400 and the slot 402. However, in the illustrated embodiment, the head projections 408 and the mouth projections 412 each have a slope. The slope of the projections 408, 412 also contribute to the strength of the seam 116. The slope causes a portion of the separating force to be redirected as a compressive force component perpendicular to the slope. Thus, the resulting compressive force from the head projections 408 have components directed toward the mouth projections 412 and the mouth projections 412 have components directed toward the head projections 408.

Another aspect of the present invention associated with the tab 400 and the slot 402 is a resistance to sliding of the wall sections 202*a*, 202*b* parallel to the longitudinal axis of the body 102 using the same mechanisms described above that prevent that the wall sections 202*a*, 202*b* from separating. Thus, the tabs 400 and the slots 402, in conjunction with the edge treatments 300 and the seam lips 302, limit the movement of the opposing ends 204 of the wall sections 202*a*, 202*b* in all directions.

Figure 6:
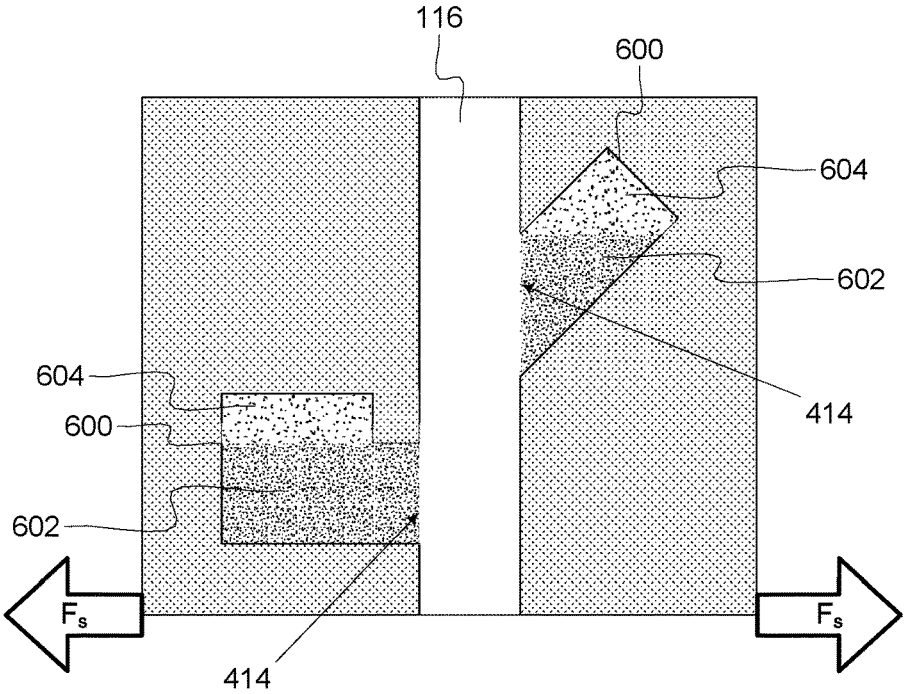
FIG. 6 illustrates general embodiments of slot retainers used to join the edges of the magazine.

FIG. 6 illustrates general embodiments of slot retainers used to join the edges of the magazine. Every slot retainer 600 is connected to and forms a portion of the seam 116. This interface is the mouth or inlet 414. During fabrication, the slot retainer 600 is also filled with the filler material. The slot retainer 600 has normal region 602 that is perpendicular to and aligned with the mouth 610. In the illustrated embodiment, the normal region is represented by the heavy stippling. The slot retainer also includes at least one shear region 604 that lies outside the normal region 602. In the illustrated embodiment, shear regions 604 are represented by the light stippling.

A separating force applied to the magazine will have a major component $F_s$ that is perpendicular to the mouth 610. The normal region 702 includes the portions of the slot retainer that are in line with the perpendicular separating force component $F_s$ and aligned with the mouth 610. Without the shear regions 704, the slot retainer 700 would offer little resistance against separation. However, the shear regions 704 are blocked from moving in the direction of the perpendicular separating force component $F_s$ by some portion of the sheet material.

Figure 7:
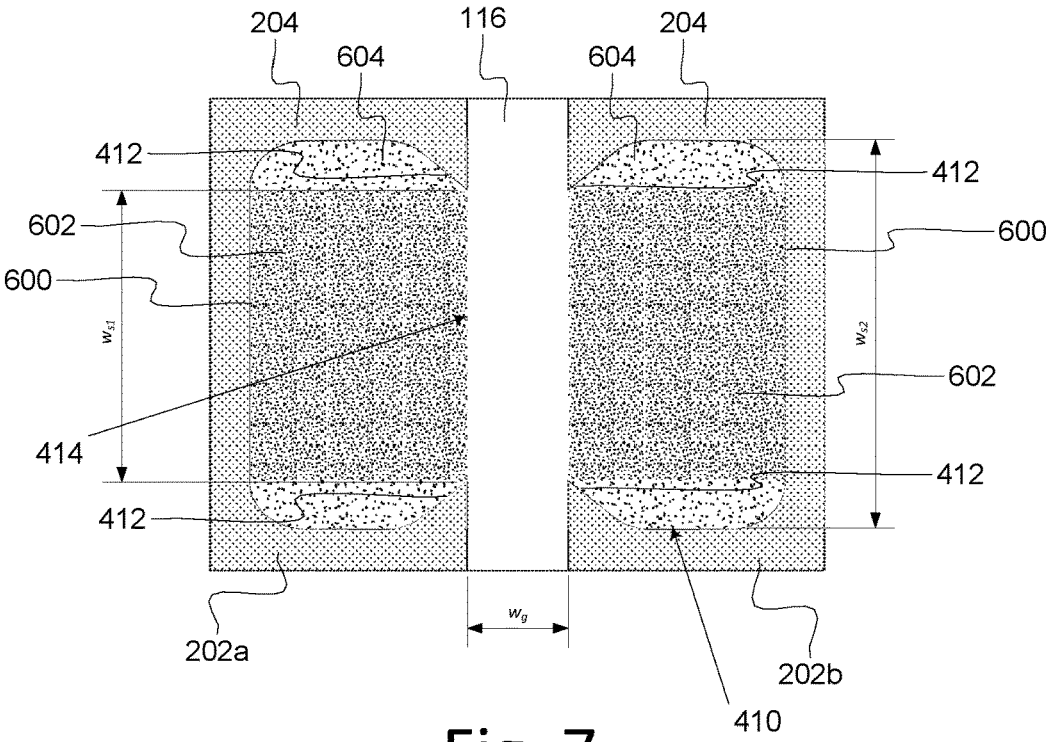
FIG. 7 is an illustration of one embodiment of a slot retainer used to join the edges of the magazine.

FIG. 7 is an illustration of one embodiment of a slot retainer used to join the edges of the magazine. The illustrated slot retainer is referred to as a dog bone or bow tie type retainer. In the illustrated embodiment, the slot 600 is defined by each wall section 202*a*, 202*b* and opposite each other. In other embodiments, the slots 600 can be offset from one another along the ends 204 of the wall sections 202*a*, 202*b*. This version of the retainer does not incorporate tabs fabricated from the sheet material. Instead, the filler material takes the place of the tab. As before, the retainer is designed to facilitate using a filler as a seam 116 to join the opposing ends 204 of the wall sections 202*a*, 202*b*. The geometries of the slots 600 provide a greater surface area for the bond between the wall sections 202*a*, 202*b* and the seam 116. Second, the geometry of the slots 602 provide resistance against movement in the direction of a perpendicular separating force component $F_s$.

The slots 600 each have a bay 410 with two inward projections 412 forming a mouth or inlet 414. The mouth 414 has a width $w_{s1}$. The bay 410 has a width $w_{s2}$. The bay width $w_{s2}$ is greater than the mouth width $w_{s1}$. The slots 600 illustrated herein are representative of the general configuration of the retainer. Aspects of the invention include varying the relative dimensions of the projections 412 and the mouth 414 to maximize the strength of the retainer. In various embodiments, the mouth width $w_{s1}$ is approximately 50% of the bay width $w_{s2}$. Each projection 412 has a length of approximately 50% of the difference between the bay width $w_{s2}$ and the mouth width $w_{s1}$. However, it is not necessary that the projection lengths be equal. In general, the mouth width $w_{s1}$ will vary between 10% and 90% of the of the bay width $w_{s2}$ with the projection 412 lengths changing accordingly. The shape of the slots 402 can vary widely without departing from the scope and spirit of the present invention.

Utilizing slot retainers 600 simplifies the fabrication process because it eliminates complicated mating techniques required by some tab and slot retainer arrangements, as discussed previously. Because it places more reliance on the filler material, the slot retainers 600 have less strength than the tab and slot retainer of FIG. 4. It should be noted that in embodiments utilizing retainers of either type, distributing the load over multiple retainers strengthens the effectiveness of the seam 116. Thus, a design using multiple slot retainers 600 has adequate strength and is suitable for use in joining the ends 204 of the wall sections 202*a*, 202*b* to fabricate a magazine body.

It should be appreciated that the shape of the slots in a retainer need not be uniform or symmetrical as depicted herein. Nor must the individual slots of the retainer have the same shape. Generally, it is sufficient the mouth 414 is narrower than at least a portion of the bay 410. With such a shape, the sheet material forming the mouth projections provides resistance and holds the filler material against the forces attempting to separate the wall ends 202*a*, 202*b* at the seam 116.

The above specification, examples, and data provide a complete description of the manufacture and use of the composition of the invention. Since many implementations of the invention can be made without departing from the spirit and scope of the invention, the invention resides in the claims hereinafter appended.

What is claimed is:

1. A firearm magazine, said firearm magazine comprising:

a body section fabricated from a sheet material, said body section being substantially tubular, said body section having a top end and a bottom end, said body section having a wall having two interior edges, each of said interior edges having a contour, said interior edges defining a gap that extends from said top end to said bottom end and defining a longitudinal axis, said interior edges defining a retainer such that said interior edges are nonlinear, said retainer configured to resist a separating force having a component that is perpendicular to said longitudinal axis, said wall having an interior face and an exterior face; and a seam filling said gap, said seam filling in around said contours, said seam fixedly connecting said interior edges, said seam including at least one retainer, said seam fabricated from a second material, said second material being different from said sheet material, said second material having a lower melting temperature than said sheet material.

2. The firearm magazine of claim 1 wherein said retainer comprises a slot defined by one of said interior edges, said slot having a mouth interfacing said gap, said slot having a first region extending in a direction perpendicular to said gap longitudinal axis and aligned with said mouth, said slot having a second region extending beyond said first region and separated from said gap by a portion of said wall.

3. The firearm magazine of claim 1 wherein said retainer comprises a slot defined by one of said interior edges, said slot having a mouth interfacing said gap, said slot having a region that is not aligned with said mouth and separated from said gap by a portion of said wall such that said wall resists movement of said region in response to a component of a separating force acting in a direction perpendicular to said gap longitudinal axis.

4. The firearm magazine of claim 1 wherein said retainer comprises:

a slot defined by a first one of said interior edges, said slot having an inlet and bay, said inlet being narrower than said bay; and a tab defined by a second one of said interior edges, said tab having a head and shaft, said head being wider than said shaft and said inlet, said shaft dimensioned to pass through said inlet, said tab fixedly secured within said corresponding first slot by said seam.

5. The firearm magazine of claim 4 wherein said head and said inlet cooperate to apply a compressive force on said seam when in response to a component of a separating force acting in a direction perpendicular to said gap longitudinal axis.

6. The firearm magazine of claim 1 wherein each said contour is selected from the group consisting of a chamfer, a bevel, and a radius.

7. The firearm magazine of claim 1 wherein said sheet material is a metal and said filler is selected from the group consisting of a plastic and an epoxy resin.

8. The firearm magazine of claim 1 wherein said sheet material is a metal and said second material is a moldable material having a polymeric base.

9. The firearm magazine of claim 1 wherein said sheet material is a metal and said second material is selected from the group consisting of thermoset plastics, thermoplastics, and plastic composites.

10. The firearm magazine of claim 1 wherein said seam is substantially flush with at least one of said interior face and said exterior face.

11. The firearm magazine of claim 1 wherein said seam is substantially flush with said interior face and said exterior face.

12. A firearm magazine, said firearm magazine comprising:

a body fabricated from a sheet metal, said body being substantially tubular, said sheet metal having a first end and an opposing second end, said first end proximate to said second end and substantially coplanar, said first end and said second end having a gap therebetween, said first end having a non-flat edge, said second end having a non-flat edge;

at least one retainer, each said at least one retainer having a first part defined by said first end along said first end edge and a second part defined by said second end along said second end edge, said first part being selected from the group consisting of a slot and a tab, said second part being a slot; and a seam fabricated from a filler material, said filler material filling said gap including said retainer.

13. The firearm magazine of claim 12 wherein said retainer first part is a tab, said retainer first part and said slot having substantially complementary shapes, said retainer first part being positioned within said retainer second part such that said filler material fixedly secures said retainer first part within said retainer second part.

14. The firearm magazine of claim 12 wherein said retainer first part is a tab, said retainer first part having a head and a shaft, said head being wider than said shaft, said retainer second part having an inlet and a bay, said inlet being narrower than said bay and said head, said shaft being narrower than said inlet.

15. The firearm magazine of claim 12 wherein said at least one retainer converts a portion of a tensile force on said seam into a compressive force on said seam.

16. The firearm magazine of claim 12 wherein each of said first end non-flat edge and said second end non-flat edge has an edge treatment selected from the group consisting of a chamfer, a bevel, and a radius.

17. A firearm magazine, said firearm magazine comprising:

a body section fabricated from a sheet material, said body section being substantially tubular, said body section having a top end and a bottom end, said body section having a wall having two interior edges, said interior edges defining a gap that extends from said top end to said bottom end and defining a longitudinal axis, each of said interior edges having a contour, each said contour being selected from the group consisting of a chamfer, a bevel, and a radius, said interior edges defining a plurality of retainers such that said interior edges are nonlinear, each of said plurality of retainers configured to resist a separating force having a component that is perpendicular to said longitudinal axis, said plurality of retainers forming a portion of said gap, said wall having an interior face and an exterior face; and a seam filling said gap, said seam filling in around said contours, said seam fixedly connecting said interior edges, said seam fabricated from a second material, said second material being different from said sheet material, said second material having a lower melting temperature than said sheet material.

18. The firearm magazine of claim 17 wherein said plurality of retainers include a first slot defined by a first one of said interior edges and a second slot defined by a second one of said interior edges, each of said first slot and said second slot having a mouth interfacing said gap, each of said first slot and said second slot having a region that is not aligned with said mouth and separated from said gap by a portion of said wall such that said wall resists movement of said region in response to a component of a separating force acting in a direction perpendicular to said gap longitudinal axis.

19. The firearm magazine of claim 17 wherein said plurality of retainers include a slot defined by a first one of said interior edges and a tab defined by a second one of said interior edges, said slot and said tab cooperating to convert a portion of a tensile force acting in a direction perpendicular to said gap longitudinal axis on said seam into a compressive force on said seam.

20. The firearm magazine of claim 17 wherein said seam is substantially flush with at least one of said interior face and said exterior face.

* * * * *